US007278460B2

(12) United States Patent
Grunstra et al.

(10) Patent No.: US 7,278,460 B2
(45) Date of Patent: Oct. 9, 2007

(54) CERAMIC CASTING CORE AND METHOD

(75) Inventors: Robert E. Grunstra, Spring Lake, MI (US); John Corrigan, Yorktown, VA (US)

(73) Assignee: Howmet Corporation, Whitehall, MI (US)

( * ) Notice: Subject to any disclaimer, the term of this patent is extended or adjusted under 35 U.S.C. 154(b) by 0 days.

(21) Appl. No.: 11/431,281

(22) Filed: May 10, 2006

(65) Prior Publication Data

US 2007/0163745 A1 Jul. 19, 2007

Related U.S. Application Data

(62) Division of application No. 11/017,227, filed on Dec. 20, 2004, now Pat. No. 7,093,645.

(51) Int. Cl.
*B22C 9/00* (2006.01)

(52) U.S. Cl. ..... 164/28; 164/122.1; 164/122.2; 164/131; 164/132

(58) Field of Classification Search ..... 164/369, 164/28, 361, 370, 340, 122.1, 122.2, 131, 164/132
See application file for complete search history.

(56) References Cited

U.S. PATENT DOCUMENTS

| | | | | |
|---|---|---|---|---|
| 1,831,555 | A * | 11/1931 | Earl, Jr. | 528/295.5 |
| 3,568,723 | A | 3/1971 | Sowards | 138/143 |
| 3,650,635 | A | 3/1972 | Wachtell et al. | 415/115 |
| 3,930,085 | A | 12/1975 | Pasiuk | 428/116 |
| 4,093,017 | A * | 6/1978 | Miller et al. | 164/28 |
| 4,221,748 | A | 9/1980 | Pasco et al. | 264/43 |
| 4,384,607 | A | 5/1983 | Wood et al. | 164/132 |
| 4,956,319 | A | 9/1990 | Dwivedi et al. | 301/127 |
| 5,072,771 | A | 12/1991 | Prasad | 164/122.1 |
| 5,119,881 | A | 6/1992 | Cagle | 164/137 |
| 5,133,816 | A | 7/1992 | Mills et al. | 156/89.23 |
| 5,295,530 | A | 3/1994 | O'Connor et al. | 164/516 |
| 5,296,308 | A | 3/1994 | Caccavale et al. | 428/586 |
| 5,394,932 | A | 3/1995 | Carozza et al. | 164/137 |
| 5,545,003 | A | 8/1996 | O'Connor et al. | 415/115 |
| 5,713,722 | A | 2/1998 | Correia et al. | 416/241 R |
| 6,161,379 | A * | 12/2000 | Haselkorn et al. | 60/323 |
| 6,286,582 | B1 | 9/2001 | Chartier et al. | 164/28 |
| 6,347,660 | B1 | 2/2002 | Sikkenga et al. | 164/137 |
| 6,350,404 | B1 | 2/2002 | Li et al. | 264/635 |
| 6,544,460 | B2 | 4/2003 | Reed et al. | 264/267 |
| 6,557,621 | B1 | 5/2003 | Dierksmeier et al. | 164/369 |
| 6,694,731 | B2 | 2/2004 | Kamen et al. | 60/524 |

* cited by examiner

*Primary Examiner*—Kevin Kerns
*Assistant Examiner*—I.-H. Lin

(57) ABSTRACT

A ceramic core for use in casting an article such as for example an airfoil, wherein the ceramic core has a pocket located at or near a region of the core that is otherwise associated with occurrence of a localized casting defect in the cast article. A covering is disposed on the core to cover the pocket and provide core outer surface features.

13 Claims, 6 Drawing Sheets

82
83
81
22
81a
26
81b
10
80
81c
85
83
87

CERAMIC CASTING CORE AND METHOD

This application is a division of U.S. Ser. No. 11/017,227 filed Dec. 20, 2004 now U.S. Pat. No. 7,093,645, and claims priority and benefits thereof.

FIELD OF THE INVENTION

The present invention relates to a ceramic core for use in casting a hollow metallic article, such as a turbine airfoil, having an internal cooling passage, and more particularly, to a ceramic core modified at one or more core regions that otherwise tend to produce casting defects in the cast article.

BACKGROUND OF THE INVENTION

Most manufacturers of gas turbine engines are evaluating advanced multi-walled, thin-walled superalloy gas turbine airfoils (i.e. turbine blade or vane) which include intricate air cooling channels to improve efficiency of airfoil internal cooling to permit greater engine thrust and provide satisfactory airfoil service life. U.S. Pat. Nos. 5,295,530 and 5,545,003 describe advanced multi-walled, thin-walled turbine blade or vane designs which include intricate air cooling channels to this end.

In casting hollow gas turbine engine blades and vanes (airfoils) having internal cooling passageways, a fired ceramic core is positioned in a ceramic investment shell mold to form internal cooling passageways in the cast airfoil. The fired ceramic core used in investment casting of hollow airfoils typically has an airfoil-shaped region with a thin cross-section leading edge region and trailing edge region. Between the leading and trailing edge regions, the core may include elongated and other shaped openings so as to form multiple internal walls, pedestals, turbulators, ribs and similar features separating and/or residing in cooling passageways in the cast airfoil.

The ceramic core typically is formed to desired core configuration by injection molding, transfer molding or pouring of an appropriate fluid ceramic core material that includes one or more ceramic powders, a binder, and optional additives into a suitably shaped core molding die. After the green molded core is removed from the die, it is subjected to firing at elevated (superambient) temperature in one or more steps to remove the fugitive binder and sinter and strengthen the core for use in casting metallic material, such as a nickel or cobalt base superalloy typically used to cast single crystal gas turbine engine blades and vanes (airfoils).

The fired ceramic core then is used in manufacture of the shell mold by the well known lost wax process wherein the ceramic core is placed in a pattern molding die and a fugitive pattern is formed about the core by injecting under pressure pattern material, such as wax, thermoplastic and the like, into the die in the space between the core the inner die walls. The pattern typically has an airfoil-shaped region with a thin cross-section trailing edge region corresponding in location to trailing edge features of the core.

The fugitive pattern with the ceramic core therein is subjected to repeated steps to build up the shell mold thereon. For example, the pattern/core assembly is repeatedly dipped in ceramic slurry, drained of excess slurry, stuccoed with coarse ceramic stucco or sand, and then air dried to build up multiple ceramic layers that form the shell mold on the assembly. The resulting invested pattern/core assembly then is subjected to a pattern removal operation, such as steam autoclaving, to selectively remove the fugitive pattern, leaving the shell mold with the ceramic core located therein. The shell mold then is fired at elevated temperature to develop adequate shell mold strength for metal casting.

Molten metallic material, such as a nickel or cobalt base superalloy, is cast into a preheated shell mold and solidified to produce an equiaxed grain, columnar grain or single crystal airfoil. The resulting cast airfoil includes the ceramic core therein so as to form internal cooling passageways upon removal of the core. The core can be removed by leaching or other conventional techniques, leaving a hollow cast metallic airfoil.

SUMMARY OF THE INVENTION

The present invention originates from, but is not limited to, attempts to cast hollow single crystal superalloy airfoils using certain ceramic core configurations wherein casting internal defects have been observed in some cast single crystal airfoils in the form of extraneous grain recrystallization (e.g. equiaxed grains) at certain localized regions of the cast airfoil. The localized casting defects in the single crystal cast airfoil were observed to correlate in location(s) to certain region(s) of the ceramic core that probably are internally stressed by virtue of the particular core manufacturing steps and core configuration involved so as in turn to exert stress on the airfoil as it solidifies in the mold.

The present invention provides a ceramic core for use in casting a hollow airfoil, or other hollow article, wherein the ceramic core is modified proximate one or more core regions that otherwise tend to promote occurrence of localized casting defects. The invention is not limited to practice in connection with the making of single crystal cast airfoils and can be used in connection with the casting of equiaxed grain and columnar grain cast airfoils as well as other metallic hollow articles of manufacture.

In an illustrative embodiment of the present invention, a ceramic core is modified to provide a pocket at one or more localized offending regions with which casting defects are associated and providing a covering such as a ceramic cover, skin, layer, coating or molding, on the core to cover the pocket and provide core outer surface features. The pocket can be formed as a recess or cavity by locally removing ceramic core material at an offending core region or by molding the core to this end.

In one illustrative embodiment of the invention, a preformed ceramic covering can used on the core to cover the pocket and can comprise a fired ceramic cover sized and shaped generally complementary to the pocket formed on the core so as to be received thereon and to maintain original outer surface features of the core at the localized region. The ceramic cover can be fastened on the lip using ceramic adhesive or other fastening means.

In a particular illustrative embodiment of the invention, the pocket is a recess or cavity machined or otherwise formed in the core region part way through the thickness such that the pocket includes a bottom wall, side walls and a peripheral lip at least partially about the pocket and on which the ceramic cover received. The pocket may be located between a pair of elongated openings adjacent the offending region wherein the elongated openings will define internal walls of a cast airfoil bordering an internal cooling passageway.

A method aspect of the present invention involves placing the modified ceramic core pursuant to the invention in a refractory mold, introducing molten metallic material in the mold about the core, and solidifying the molten metallic material in a manner to form a cast article in the mold.

The present invention is advantageous to reduce or eliminate the occurrence of casting defects, such as grain recrystallization, at one or more localized regions of a cast airfoil or other article of manufacture.

Other advantages and features of the present invention will become apparent from the following detailed description taken with the following drawings.

DESCRIPTION OF THE INVENTION

Figure 1:
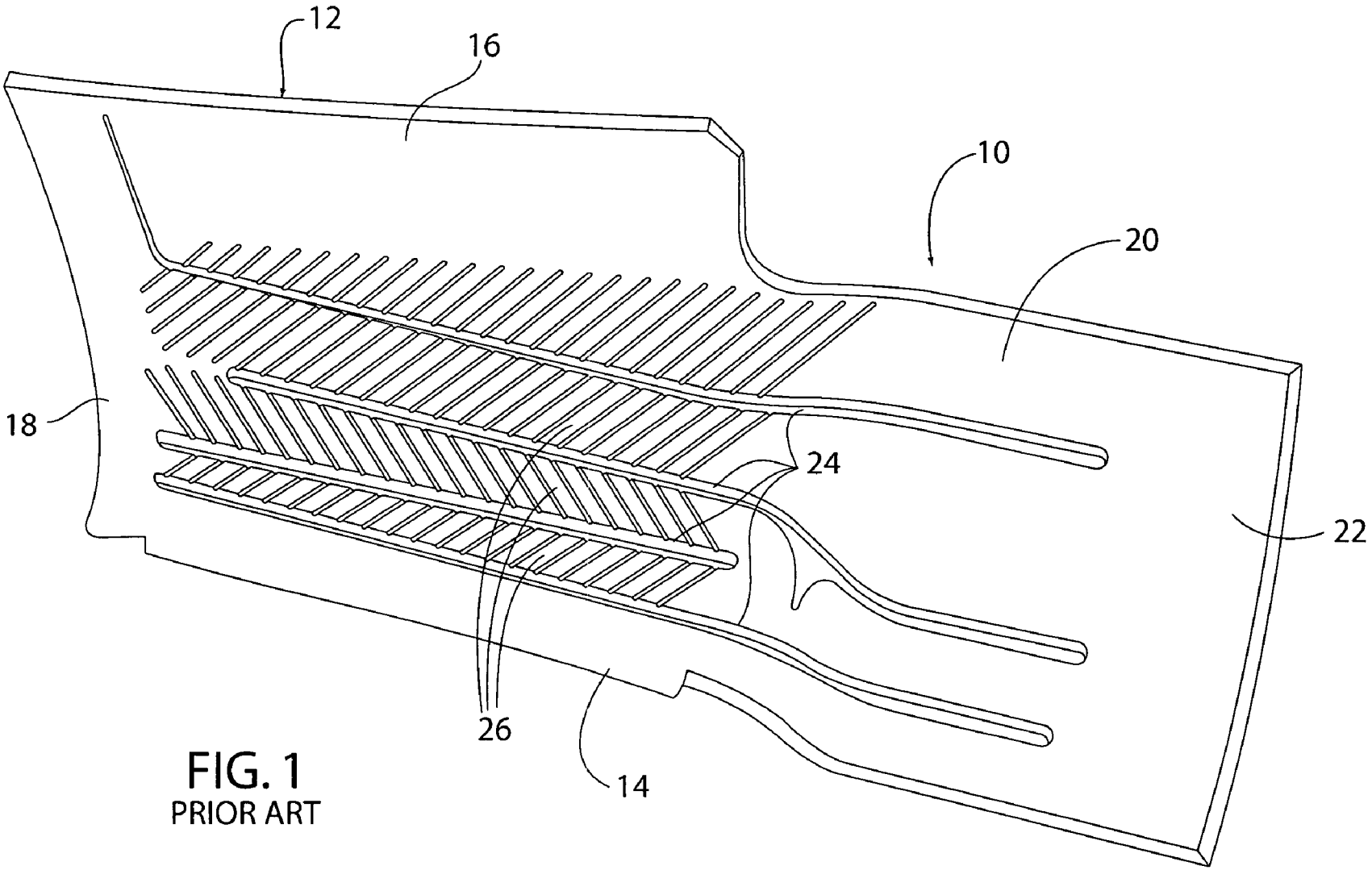
FIG. 1 PRIOR ART
FIG. 1 is a perspective view of a ceramic core which was used in attempts to cast a single crystal airfoil but which produced casting defects in the form of grain recrystallization at localized regions of the cast single crystal airfoil.

Although the invention is described in detail below with respect to casting single crystal airfoils, it is not so limited and can be used to cast any hollow metallic article of manufacture to reduce or eliminate casting defects at one or more regions thereof. The present invention originated from attempts to cast hollow single crystal nickel base superalloy airfoils using a fired ceramic core 10 of the type shown in FIG. 1 for purposes of illustration and not limitation. The fired ceramic core 10 includes an airfoil shaped region 12 having a leading edge region 14, trailing edge region 16 and tip region 18. The airfoil region 12 is formed integral with a root region 20 having a core print region 22).

Figure 6:
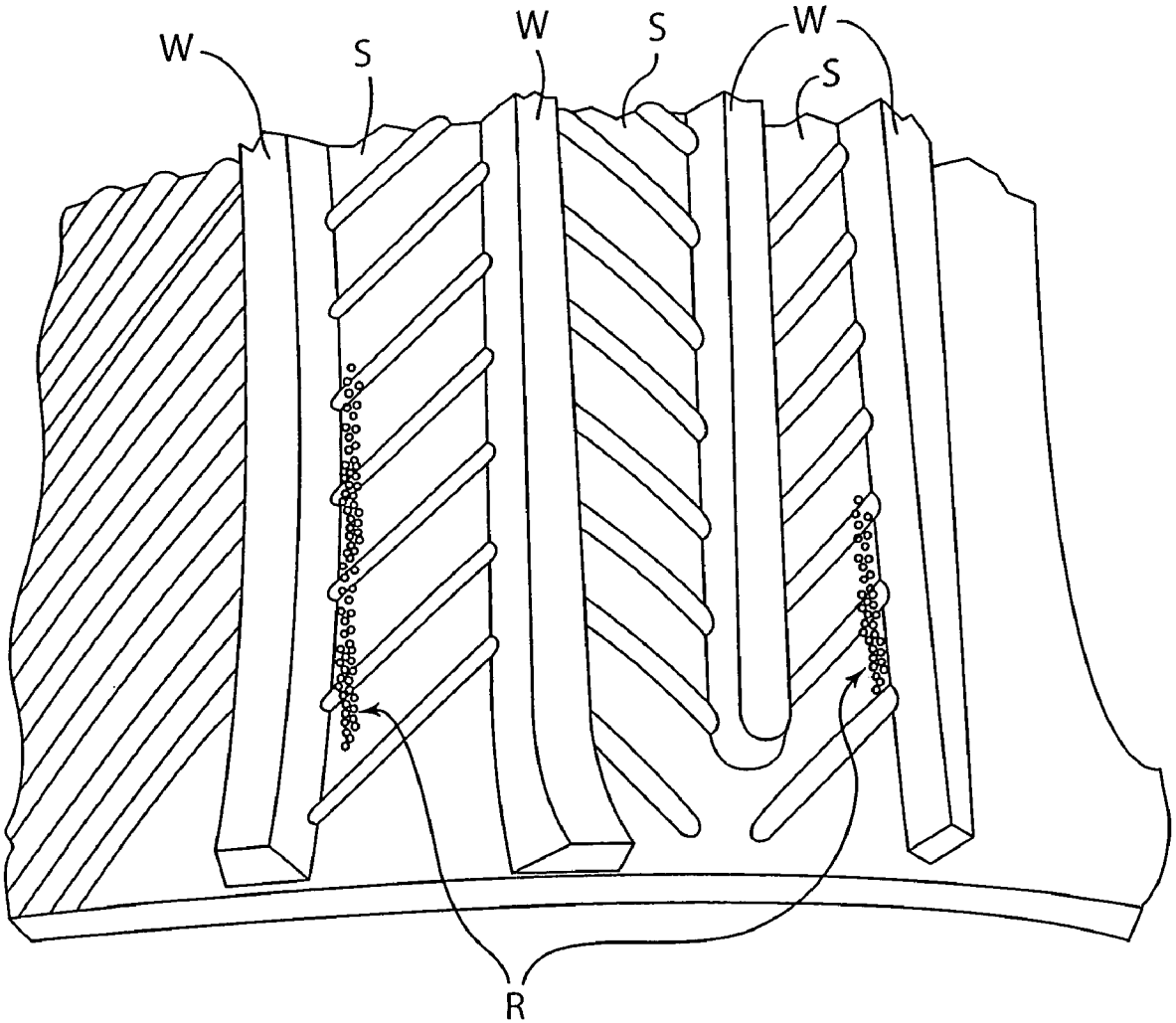
FIG. 6 PRIOR ART
FIG. 6 is a partial view of a cast airfoil showing casting defects in the form of grain recrystallization at localized fillet regions at the intersection of internal walls and cooling passageway surfaces of the single crystal cast airfoil made with an unmodified ceramic core. The outer airfoil wall has been cut away to reveal the internal cast features.

Such casting attempts resulted in cast single crystal airfoils having casting defects in the form of extraneous grain recrystallization (e.g. an elongated band of equiaxed grains) at certain localized fillet regions R of the cast airfoil as shown in FIG. 6, wherein the outer airfoil wall has been cut away to reveal the internal cast features. In particular, undesirable grain recrystallization is observed to occur at internal fillets located at the intersection of internal ribs W and cooling passageway surfaces S of the cast single crystal airfoil, although recrystallization can occur anywhere on the surfaces and ribs of the airfoil. The internal ribs W are formed by nickel base superalloy filling the elongated openings 24 in the airfoil regions 12 of the core 10, FIG. 1. The cooling passageway surface S is formed by respective elongated core sections 26 between adjacent openings 24 of the core 10. The single crystal airfoils were cast using a nickel base superalloy known as PWA 1483. In the casting attempts, the fired ceramic core 10 comprised a silica based ceramic material. However, the ceramic core 10 in general can comprise a silica based, alumina based, zircon based, zirconia based, or other suitable core ceramic materials and mixtures thereof known to those skilled in the art. The particular ceramic core material forms no part of the invention, suitable ceramic core materials being described in U.S. Pat. No. 5,394,932. The core material is chosen to be chemically leachable from the cast airfoil formed thereabout in order to form a hollow cast airfoil.

The observed localized grain recrystallization defects in the single crystal cast airfoils correlated in location to certain fillet-forming regions R of the ceramic core 10 that were shown by metallographic analysis, such as visual grain etching of cross-sectional samples, to be highly internally stressed. In particular, while not wishing to be bound by any theory, the offending fillet-forming regions R of the fired ceramic core 10 associated with the observed localized grain recrystallization defects were believed to impart a high enough hoop stress to the affected fillet regions R of the cast single crystal airfoils during the single crystal casting process to produce the observed grain recrystallization defects. The hoop stress extended in a lateral direction relative to the long axis of the core.

The present invention involves modifying the fired ceramic core 10 at, near or otherwise proximate the offending fillet-forming regions R associated with the observed localized grain recrystallization defects in a manner to reduce or eliminate occurrence of the grain recrystallization defects in the cast airfoils. The invention also envisions modifying a green (unfired) core to this same end. For purposes of illustration and not limitation, a green ceramic core having a plastic binder may be machined before firing, while a green ceramic core having a wax-based binder typically may be machined after firing when the core has more strength.

Figure 2:
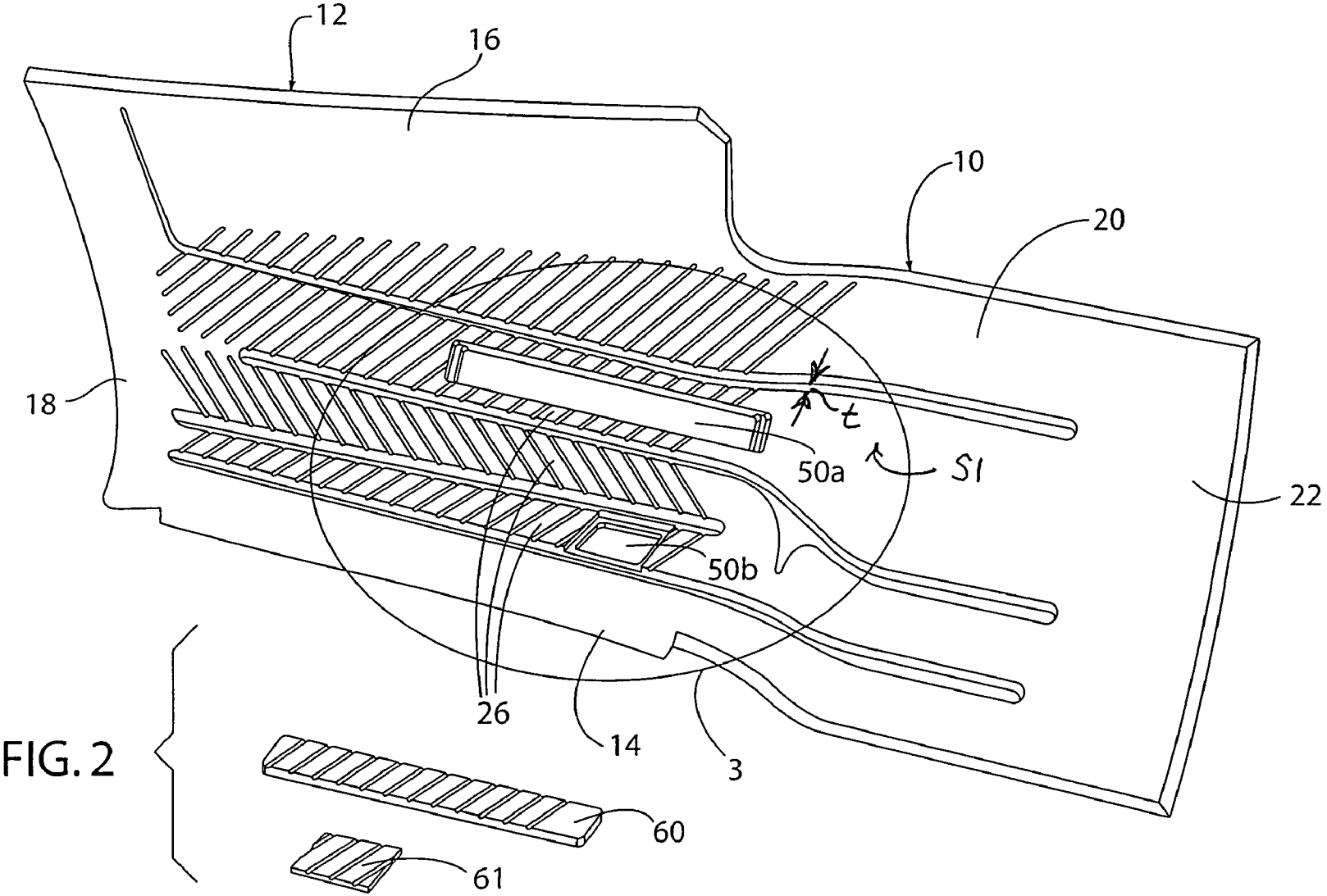
FIG. 2 is a perspective view of a ceramic core similar to that of FIG. 1 being modified pursuant to an illustrative embodiment of the invention to include pockets at offending core regions with which casting defects are associated.
Figure 3:
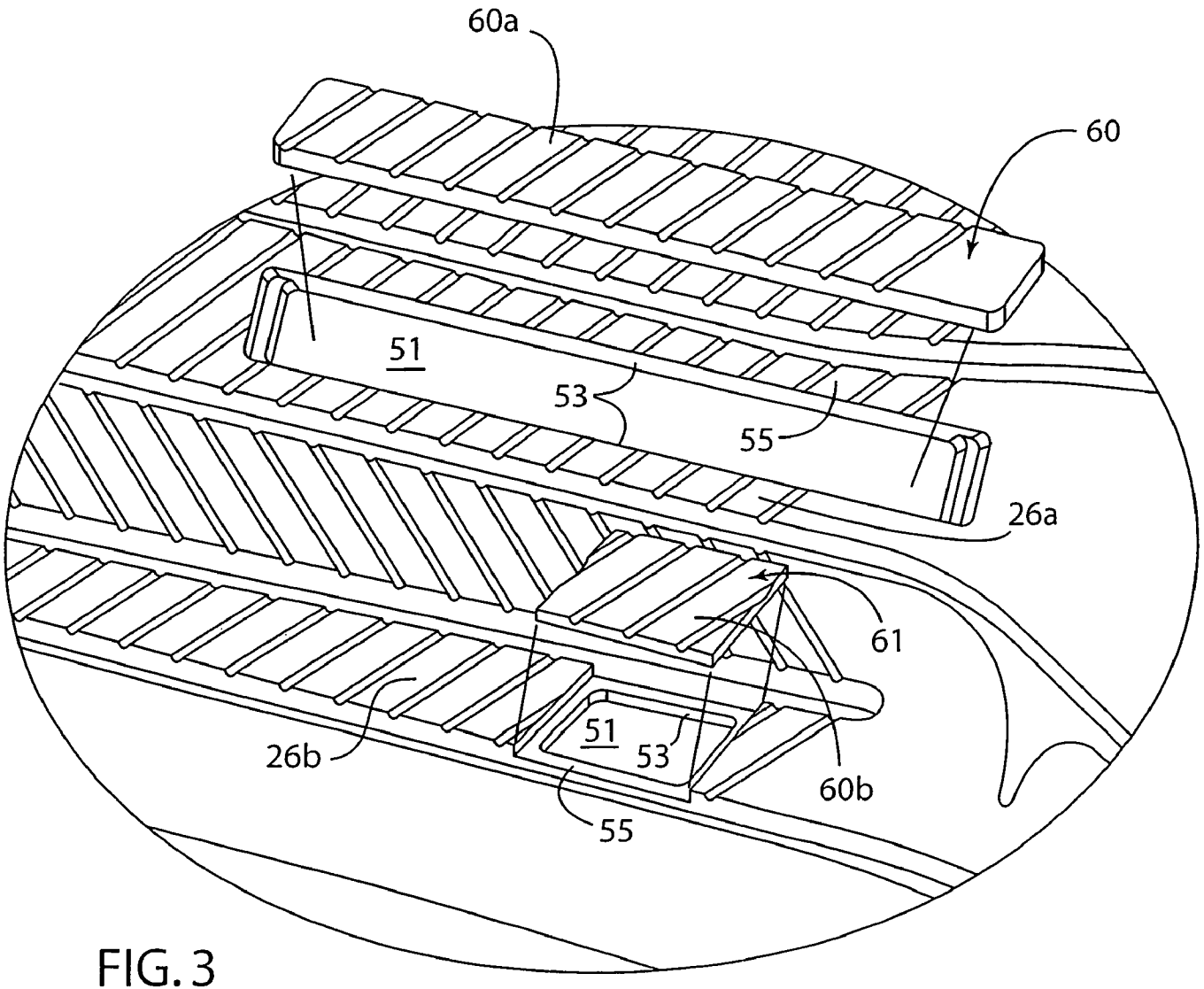
FIG. 3 is an enlarged perspective view of the encircled region of FIG. 2 showing a ceramic covering being placed on the core to cover the pockets.

In an illustrative embodiment of the present invention, the fired ceramic core 10 is modified by removing ceramic core material from the localized offending fillet-forming regions R with which the casting defects are associated so as to form a recessed pocket 50*a*, 50*b* at those regions R, FIGS. 2-3. Although not wishing to be bound by any theory, the pockets 50*a*, 50*b* are thought to relieve internal core stresses enough at regions R and thus at regions of the cast airfoil to reduce occurrence of the observed casting defects in the cast single crystal airfoil.

The pockets 50*a*, 50*b* can be formed by machining the ceramic core 10 at regions R at least part way through the thickness of the core regions such that the pocket as a bottom wall 51, side walls 53 and a peripheral lip 55 for receiving a ceramic cover for the pocket. Pocket 50*a* includes a peripheral lip 55 at opposite transverse ends thereof, while pocket 50*b* includes peripheral lip 55 about the longitudinal sides and transverse ends thereof. The ceramic core can be machined to this end by milling or any other suitable machining or ceramic core material removal process. For example, a laser machining, ultrasonic machining and other processes may be employed to remove ceramic core material to form the pockets 50*a*, 50*b*. Alternately, the ceramic core 10 can be initially molded or otherwise formed in-situ to include the pockets 50*a*, 50*b*. For example, a fugitive core material (e.g. wax, plastic and the like) can be disposed in a core die cavity to form the pockets on the core formed in the die cavity. The fugitive material forming the pockets on the core is removed subsequently (e.g. burned off during core firing at elevated temperature) to form the pockets 50*a*, 50*b*.

The pockets can be formed by machining, molding and the like as described on the core side S1 shown, on the opposite core side, or on both of the core sides at or near any offending core region R of the core 10 and can extend part way or all of the way through a particular core dimension (e.g. core thickness between the sides, core width, etc.) at the particular region R.

The location, size and shape of the pockets 50*a*, 50*b* are selected empirically to achieve a reduction or elimination of the casting defects in the cast single crystal airfoils or other cast article. The pockets can have any suitable size and shape to this end. For purposes of illustration and not limitation, for the ceramic core 10 shown in FIGS. 2-3, each pocket 50*a*, 50*b* can have a depth of 0.2 inch in the core thickness dimension t. The width of trailing edge pocket 50*a* varies from 0.50 inch at its widest to 0.42 inch at its narrowest and extends partially across the overall width of the core section 26*a*. The width of leading edge pocket 50*b* varies from 0.43 inch at its widest to 0.35 at its narrowest and extends across the entire width of the core section 26*b*. The length of trailing edge pocket 50*a* along associated core sections 26*a* is 3.5 inches while that of leading edge pocket 50*b* associated with core section 26*b* is 1.15 inch, again for purposes of illustration only since their location, size and shape will be selected to reduce or eliminate the casting defects in the cast single crystal airfoils.

As is apparent from FIGS. 2-3, the pockets 50*a*, 50*b* are formed as recesses or cavities in elongated core sections 26 that reside between the elongated openings 24 proximate the offending fillet-forming core regions R. As mentioned above, the internal walls W are formed by nickel base superalloy filling the elongated openings 24 in the airfoil regions 12 of the core 10.

Figure 3A:
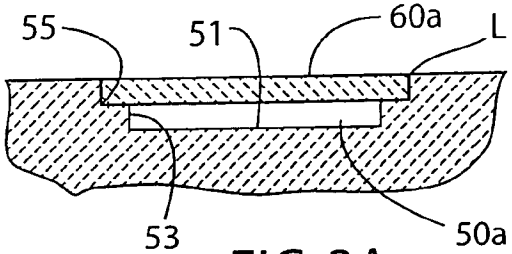
FIG. 3A is a partial sectional view of a pocket and the ceramic covering closing off the pocket.
Figure 4:
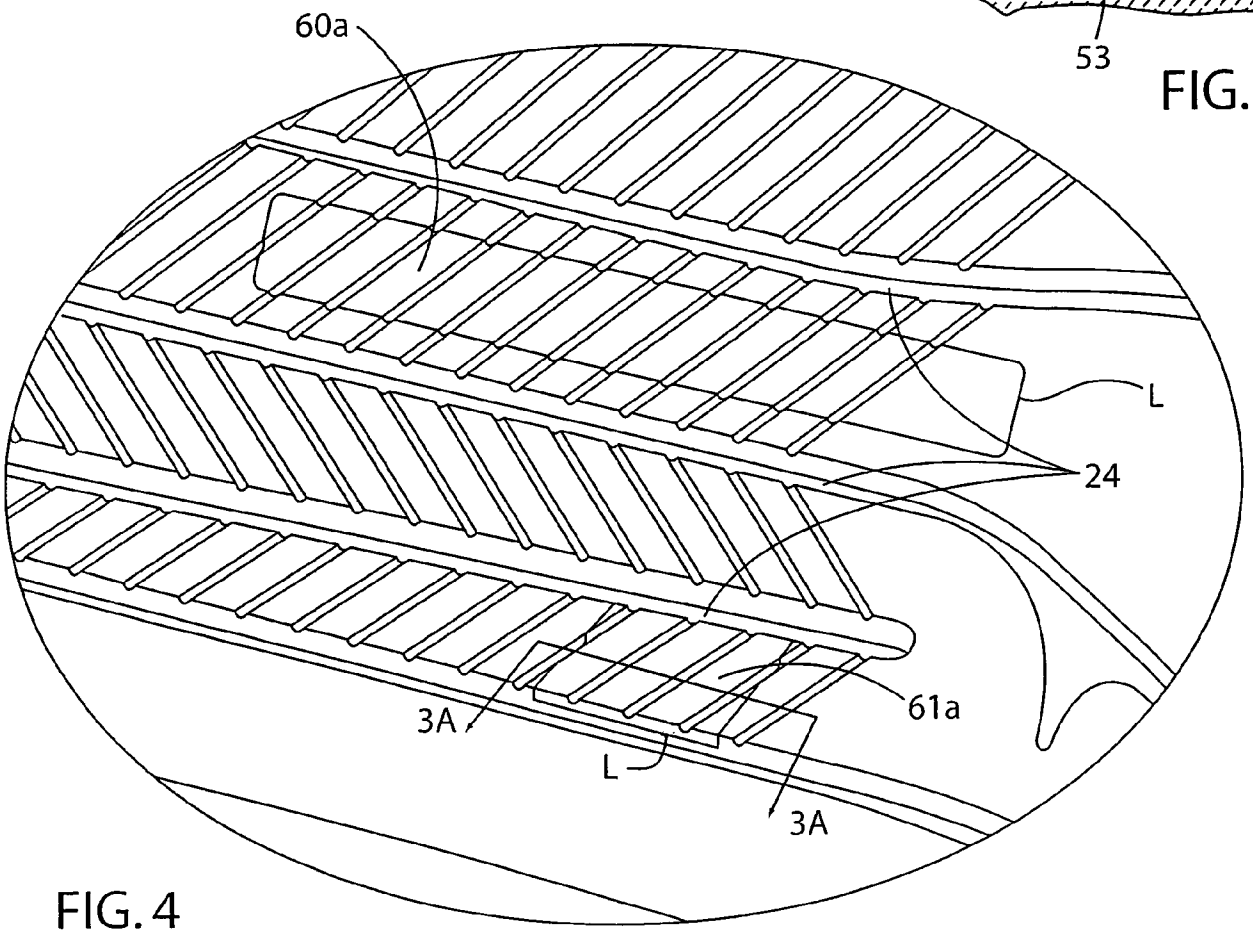
FIG. 4 is a perspective view similar to FIG. 3 of a ceramic core after modification pursuant to an illustrative embodiment of the invention to include the ceramic covering on the core at the offending core regions to close off the pockets.

Referring to FIG. 3, a covering 60 is shown being placed over the pockets 50*a*, 50*b* to cover or close off the open sides of the pockets. The covering 60 is shown for purposes of illustration and not limitation in the form of fired preformed ceramic covers 60*a*, 60*b* being placed on peripheral lips 55 formed on the core extending about respective pockets 50*a*, 50*b* to cover the pockets 50*a*, 50*b*. The fired ceramic covers 60*a*, 60*b* are sized and shaped complementary to the respective pocket 50*a*, 50*b* so as to be received on lips 55 and to return outer surface features of the core at the localized regions R substantially to their original form; i.e. original surface dimensions and features as is apparent in FIG. 4 where only narrow gaps L are barely visible at the boundary of the ceramic cover 60*a* after it is adhered in place. The narrow gaps L can be eliminated by providing the covering 60 on the core 10 by ceramic molding techniques. The empty pockets 50*a*, 50*b* reside under the covers 60*a*, 60*b* for stress relief purposes as illustrated in FIG. 3A for pocket 50*a* and cover 60*a*. The ceramic covers 60*a*, 60*b* can be fastened on the lips 55 using ceramic adhesive such as CERABOND 989 alumina-based adhesive, or using other fastening means such as including, but not limited to, dovetail joints, slid fit or thermal expansion forces when the covers are made of a material having a different coefficient of thermal expansion from that of the main body of the core. The ceramic covers 60*a*, 60*b* can comprise thin elongated strips of ceramic insert material, which may be the same ceramic material as the core or a different ceramic material. The ceramic covers 60*a*, 60*b* can made by transfer, injection or poured molding a ceramic material, which may be the same or different in composition from that of the main body of the core, as well as machining and other techniques. If a pocket 50*a* and/or 50*b* is formed all the way through a dimension of the core, a covering 60 can be provided on the core 10 to cover both open sides of such a pocket.

The invention envisions the covering 60 to be provided on the core 10 in other ways. For purposes of illustration and not limitation, the covering 60 can comprise a ceramic skin, layer, coating or molding applied over the pockets 50*a*, 50*a* in a subsequent ceramic application step, such as a transfer, injection or poured molding operation in a die where ceramic material is introduced about all or a portion of the core 10 to cover the core 10 with additional ceramic material, which may be the same or different from that of the core itself. The covering 60 can comprise a ceramic skin or layer formed over the pockets 50*a*, 50*a* integrally to the core 10 when the core 10 is molded by transfer, injection or poured molding in a die. The pockets would initially be defined by fugitive patterns of the pockets in the die cavity, the fugitive patterns being subsequently removed after the core is molded so as to leave the pockets on the core closed off by the integral ceramic skin or layer. Moreover, the ceramic core 10 can be joined or molded with a second ceramic core component that forms operative features of the core itself in a manner described in U.S. Pat. No. 5,394,932, which is incorporated herein by reference, in a manner that the second core component covers the pockets 50*a*, 50*b*. The second core component may be the same or different ceramic material from that of the core 10 itself. A composite core thereby can be provided.

The invention also envisions optionally at least partially filling the pockets 50*a*, 50*b* beneath the covers 60*a*, 60*b* with a mass of solid or foam filler material such as, for purposes of illustration and not limitation a ceramic material, in a manner to prevent molten superalloy from entering the pockets during casting of the molten superalloy in the shell mold about the fired ceramic core. However, in some applications of the cast airfoil or other cast article, molten superalloy leakage into one or more of the pockets can be tolerated, whether the pockets are empty or filled. One or more of the pockets thus can include therein any molten superalloy leakage which has solidified therein. Any solidified superalloy residing in one or more of the pockets is eventually removed from the cast airfoil when the ceramic core is removed therefrom.

Subsequent attempts to cast the above-described hollow single crystal nickel base superalloy airfoils using modified fired ceramic cores 10 pursuant to the invention (e.g. as illustrated in FIGS. 2-3) resulted in cast single crystal airfoils which were free of the recrystallization defects of the type observed when the modified ceramic core of FIG. 1 was used to cast similar single crystal airfoils under like casting conditions.

Although the invention has been illustrated above with respect to modifying the ceramic core 10 at particular core regions R, those skilled in the art will appreciate that one or more core regions R can be modified as needed to reduce or eliminate casting defects associated with any or each region of the core.

Figure 5:
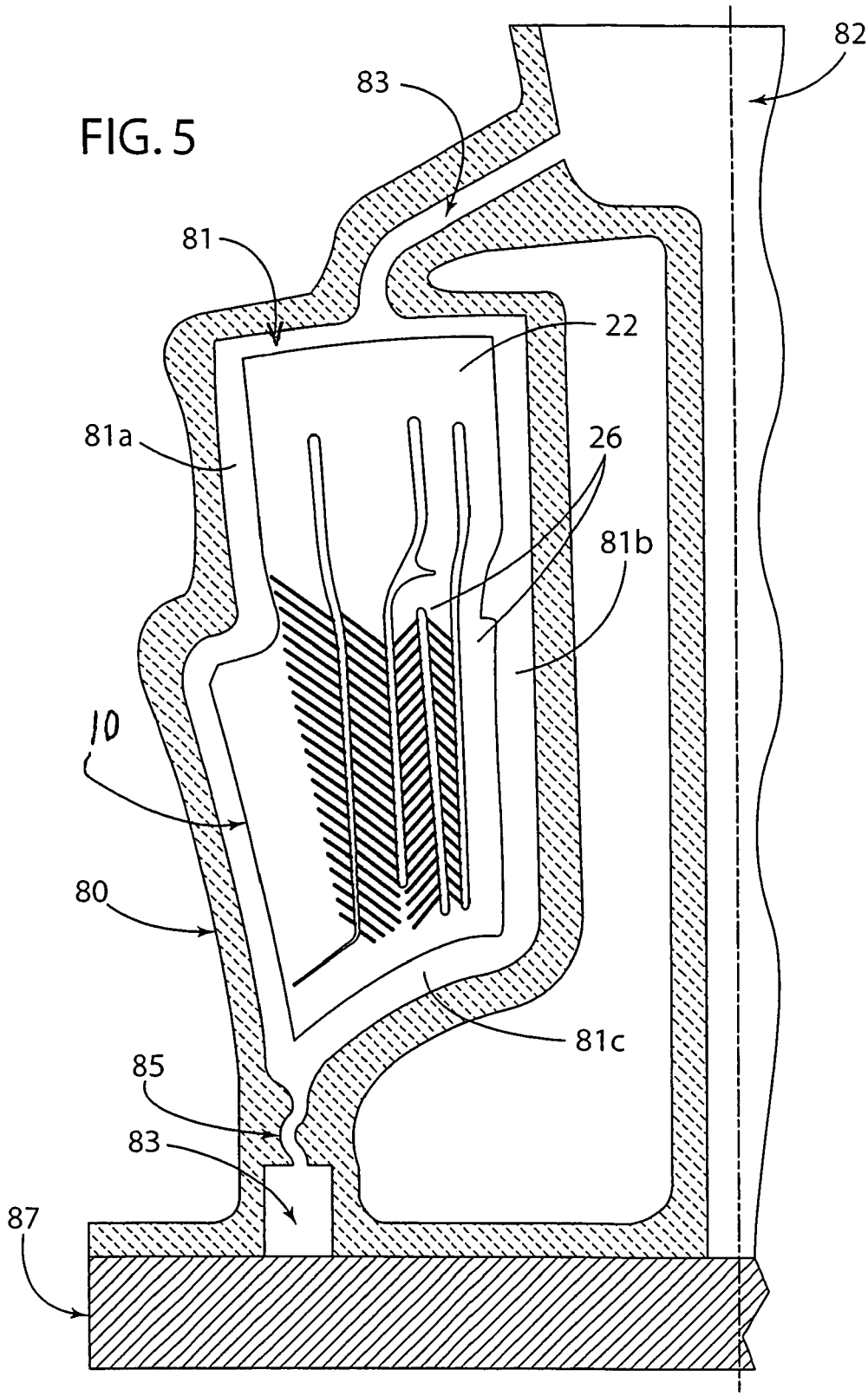
FIG. 5 is a sectional view of a ceramic shell mold having a ceramic core therein to cast a hollow single crystal airfoil.

Referring to FIG. 5, for purposes of illustration and not limitation, the modified ceramic core of the invention can be placed in a conventional ceramic investment shell mold 80 shown having the modified ceramic core 10 residing in a mold cavity 81 of suitable shape to produce a turbine airfoil (or other cast article). In particular, the mold cavity 81 includes a root cavity section 81*a*, airfoil cavity section 81*b* and tip cavity section 81*c* with the core 10 residing in the airfoil cavity section 81*b*. A molten superalloy, such as a known nickel or cobalt base superalloy, is cast into the ceramic investment shell mold 80 via pour cup 82 and runner 83. The molten superalloy can be directionally solidified as is well known in the mold 80 about the core 10 to produce a cast single crystal airfoil with the ceramic core 10 therein. For example, a plurality of crystals or grains are nucleated and grow upwardly in a starter cavity 83 of the mold adjacent a chill 87 and progress upwardly through a crystal selector passage 85 where a single crystal or grain is selected for propagation through the molten superalloy in the mold cavity 81. Alternately, a single crystal seed (not shown) may be used in lieu or in addition to starter cavity 83 and crystal selector passage 85. The solidification front of the single crystal or grain can be propagated through the molten superalloy in the mold cavity 81 by using the well known mold withdrawal and/or the power down techniques. After the single crystal airfoil has solidified in the mold cavity, the mold 80 and the core 10 are removed to provide a cast single crystal airfoil with internal passages at regions formerly occupied by the ceramic core 10. The mold is removed from the solidified casting using a mechanical knock-out operation followed by one or more known chemical leaching or mechanical grit blasting techniques. The core 10 is selectively removed from the solidified airfoil casting by chemical leaching or other conventional core removal techniques.

The present invention is advantageous to reduce or eliminate the occurrence of casting defects, such as grain recrystallization, at one or more localized regions of a cast hollow equiaxed, columnar, or single crystal airfoil or other cast articles.

It will be apparent to those skilled in the art that various modifications and variations can be made in the embodiments of the present invention described above without departing from the spirit and scope of the invention as set forth in the appended claims.

We claim:

1. A method of making a ceramic core for use in casting a hollow article where the core is removed from the cast article to form a passage therein, comprising forming the ceramic core including machining or molding a pocket proximate a region of the core that is otherwise associated with occurrence of a localized casting defect in the cast article and covering said pocket to close off an open outer side of the pocket.

2. The method of claim 1 wherein the pocket is formed by removing machining to remove ceramic material from the core.

3. The method of claim 1 wherein the pocket is molded on the core in a die cavity.

4. The method of claim 1 wherein said covering is molded on the core integral thereto.

5. The method of claim 1 including the further step of disposing a filler material in the pocket after the pocket is formed.

6. The method of claim 1 including making said covering sized and shaped to maintain substantially original outer surface features at the core region and attaching said covering on the core to cover the pocket.

7. The method of claim 1 including covering the pocket by applying a ceramic skin, layer, coating or molding on the core to cover the pocket.

8. The method of claim 1 including covering the pocket by joining or molding a second ceramic core component to the core.

9. The method of claim 1 wherein said pocket is formed to have side walls that extend at least part way through a dimension of the core region.

10. The method of claim 1 wherein the pocket comprises a recess in the core at said region, the recess extending part way through a dimension of the core region such that the pocket has a bottom wall and side walls.

11. The method of claim 10 including forming a peripheral lip on the core at least partially about the pocket.

12. The method of claim 1 wherein said region of said core is formed to include multiple elongated openings for defining internal walls of a single crystal airfoil bordering an internal cooling passageway and wherein said pocket is formed in said region between a pair of said elongated openings.

13. The method of claim 12 wherein said pocket is formed to extend along a portion of the length of said elongated openings.

* * * * *